US012503810B2

(12) United States Patent
Liu et al.

(10) Patent No.: US 12,503,810 B2
(45) Date of Patent: Dec. 23, 2025

(54) DOUBLE-TUB LAUNDRY DEVICE

(71) Applicants: Qingdao Haier Laundry Electric Appliances Co., Ltd, Shandong (CN); Haier Smart Home Co., Ltd., Shandong (CN)

(72) Inventors: Kai Liu, Qingdao (CN); Sheng Xu, Qingdao (CN); Yanfang Lv, Qingdao (CN)

(73) Assignees: QINGDAO HAIER LAUNDRY ELECTRIC APPLIANCES CO., LTD, Qingdao (CN); HAIER SMART HOME CO., LTD., Qingdao (CN)

( * ) Notice: Subject to any disclaimer, the term of this patent is extended or adjusted under 35 U.S.C. 154(b) by 112 days.

(21) Appl. No.: 18/292,637

(22) PCT Filed: Jun. 17, 2022

(86) PCT No.: PCT/CN2022/099367
§ 371 (c)(1),
(2) Date: Jan. 26, 2024

(87) PCT Pub. No.: WO2023/005494
PCT Pub. Date: Feb. 2, 2023

(65) Prior Publication Data

US 2024/0360612 A1 Oct. 31, 2024

(30) Foreign Application Priority Data

Jul. 28, 2021 (CN) ..... 202110859552.8

(51) Int. Cl.
*D06F 39/12* (2006.01)
*D06F 34/14* (2020.01)
(Continued)

(52) U.S. Cl.
CPC ..... *D06F 39/12* (2013.01); *D06F 34/14* (2020.02); *D06F 29/00* (2013.01); *D06F 58/02* (2013.01); *D06F 2103/56* (2020.02)

(58) Field of Classification Search
CPC ..... D06F 34/14; D06F 29/00; D06F 58/02; D06F 39/12; D06F 2103/56; D06F 34/26
See application file for complete search history.

(56) References Cited

U.S. PATENT DOCUMENTS

2006/0156765 A1* 7/2006 Sunshine ..... D06F 39/12 68/19
2007/0119072 A1* 5/2007 Kim ..... D06F 58/26 34/550

(Continued)

FOREIGN PATENT DOCUMENTS

CN 108085941 A 5/2018
CN 110130053 A 8/2019

(Continued)

OTHER PUBLICATIONS

International Search Report (English translation included) dated Sep. 1, 2022, in corresponding International Application No. PCT/CN2022/099367, 8 pages.

*Primary Examiner* — Benjamin L Osterhout
(74) *Attorney, Agent, or Firm* — Maier & Maier, PLLC

(57) ABSTRACT

A double-tub laundry device includes a first tub assembly, a second tub assembly, a first valve assembly, a second valve assembly, a first fan, and a second fan. The first valve assembly includes a first blocking mechanism and a first valve casing having a first air inlet chamber and a first air outlet chamber; the first blocking mechanism is configured to block both a first air inlet pipe and a first air outlet pipe from the outside; the second valve assembly includes a second blocking mechanism and a second valve casing having a second air inlet chamber and a second air outlet (Continued)

chamber; and the second blocking mechanism is configured to block both a second air inlet pipe and a second air outlet pipe from the outside. Embodiments achieve partitioned washing of the double-tub drum washing machine and independent air drying of each tub assembly.

8 Claims, 4 Drawing Sheets

(51) Int. Cl.

| | |
|---|---|
| ***D06F 103/56*** | (2020.01) |
| *D06F 29/00* | (2006.01) |
| *D06F 58/02* | (2006.01) |

(56) References Cited

U.S. PATENT DOCUMENTS

| | | | | |
|---|---|---|---|---|
| 2011/0041564 | A1* | 2/2011 | Beihoff | D06F 58/206 165/104.19 |
| 2011/0185511 | A1* | 8/2011 | Ryoo | D06F 39/088 68/19 |
| 2020/0240065 | A1* | 7/2020 | Underly | D06F 37/04 |
| 2021/0148029 | A1* | 5/2021 | Lv | D06F 29/005 |

FOREIGN PATENT DOCUMENTS

| | | | | | |
|---|---|---|---|---|---|
| CN | 211972793 | U | | 11/2020 | |
| CN | 213740119 | U | | 7/2021 | |
| CN | 113718464 | A | * | 11/2021 | D06F 25/00 |
| CN | 113818183 | A | * | 12/2021 | D06F 25/00 |
| CN | 215887585 | U | | 2/2022 | |
| CN | 215887608 | U | | 2/2022 | |
| EP | 2436818 | A1 | * | 4/2012 | D06F 25/00 |
| EP | 4174228 | A1 | * | 5/2023 | D06F 58/20 |
| JP | 2007222455 | A | | 9/2007 | |
| JP | 2012249740 | A | * | 12/2012 | |
| WO | WO-2022199641 | A1 | * | 9/2022 | D06F 37/30 |
| WO | WO-2022233218 | A1 | * | 11/2022 | D06F 37/22 |

* cited by examiner

DOUBLE-TUB LAUNDRY DEVICE

FIELD

The present disclosure relates to the technical field of clothing washing, and specifically provides a dual-cylinder washing apparatus.

BACKGROUND

A washing apparatus is a clothing treatment apparatus that can perform washing, rinsing, spinning and/or drying operations on clothing. Some washing apparatuses are further provided with functions such as air washing, disinfection, sterilization and fragrance enhancement. There are many types of washing apparatuses, such as the most common drum washing machines, pulsator washing machines, and washing-drying integrated machines. In addition, in order to achieve partitioned washing, dual-cylinder washing apparatuses have also appeared in the market.

Taking a dual-cylinder drum washing machine as an example, each cylinder assembly of existing dual-cylinder drum washing machines includes an outer cylinder and an inner cylinder. During washing, a certain amount of water is first injected into the outer cylinder, and then the inner cylinder drives the clothing to turn over, achieving washing of the clothing. The dual-cylinder drum washing machine is designed by imitating the principle of striking the clothing with a bar hammer. After the clothing is washed, the outer cylinder and a window gasket connected to the outer cylinder are both moist, that is, there is residual water on an inner wall thereof. After long term use, growth of bacteria is very likely to occur. In case of only opening door glass to dry the outer cylinder and the window gasket naturally, the effect would be very limited; moreover, the window gasket includes a wrinkle part, which is very unfavorable for the release of water vapor. As the users operating this cylinder again, the bacteria and dirt on the inner wall of the outer cylinder and in the window gasket can easily cause a secondary pollution to the clothing, seriously affecting the washing effect and resulting in poor user experience.

A drum washing machine is disclosed in the patent No. 201922216894.9, which includes an air inflow pipeline and an air outflow pipeline with a fan. The air inflow pipeline and the air outflow pipeline are both communicated with the outer cylinder, and flowing air can enter the outer cylinder and air dry an inner surface of the outer cylinder and an outer surface of the inner cylinder. The flowing air is then discharged out of the body of the drum washing machine through the air outflow pipeline, that is, the interior of the outer cylinder is air dried by the external air, thus preventing the generation of dirt and growth of bacteria. However, this type of drum washing machine cannot guarantee that external dirt does not enter the drum washing machine, and it still has certain safety hazards.

A vent structure and a washing machine are disclosed in the patent No. 201810106076.0. The vent structure includes a vent and a rotating body. The rotating body is rotatably arranged at the vent, and the rotating body is radially provided with a first connecting hole that penetrates through the rotating body. When the rotating body rotates, the first connecting hole can be communicated with the vent or the rotating body can block the vent, thereby selectively communicating the first connecting hole with the vent, thus achieving the purpose of opening or closing the vent through the rotation of the rotating body. The vent structure can be arranged on a front panel of a housing of the washing machine, or also arranged in a rear vent at the same time. However, when the vent structure is only arranged on the front panel, external dirt can easily enter the drum washing machine from the rear vent. If the vent structure is also arranged in the rear vent at the same time, it is necessary to close both parts of the vent structure respectively to achieve complete blocking of the drum washing machine from the outside, which is very unfavorable for the layout of the product structure and seriously increases the complexity of product design.

Moreover, none of the above two patent documents relates to a dual-cylinder washing apparatus, and none of them can meet the requirement of separate air drying of the two cylinders on the basis of partitioned washing.

Accordingly, there is a need for a new dual-cylinder washing apparatus in the art to solve the above problem.

SUMMARY OF INVENTION

The present disclosure aims to solve the above technical problem, that is, to solve the problem that existing dual-cylinder washing apparatuses cannot achieve independent air drying at the same time of achieving partitioned washing.

The present disclosure provides a dual-cylinder washing apparatus, which includes a first cylinder assembly, a second cylinder assembly, a first valve assembly, a second valve assembly, a first fan and a second fan;

the first valve assembly includes a first blocking mechanism, and a first valve casing with a first inflow chamber and a first outflow chamber that are arranged independently from each other; the first inflow chamber is communicated with a first air inflow pipeline that communicates the outside with the first cylinder assembly, and the first outflow chamber is communicated with a first air outflow pipeline that communicates the outside with the first cylinder assembly; the first fan is arranged on the first air inflow pipeline and/or the first air outflow pipeline, and the first blocking mechanism is arranged to be capable of blocking the first air inflow pipeline and the first air outflow pipeline from the outside simultaneously; and the second valve assembly includes a second blocking mechanism, and a second valve casing with a second inflow chamber and a second outflow chamber that are arranged independently from each other; the second inflow chamber is communicated with a second air inflow pipeline that communicates the outside with the second cylinder assembly, and the second outflow chamber is communicated with a second air outflow pipeline that communicates the outside with the second cylinder assembly; the second fan is arranged on the second air inflow pipeline and/or the second air outflow pipeline, and the second blocking mechanism is arranged to be capable of blocking the second air inflow pipeline and the second air outflow pipeline from the outside simultaneously.

In a preferred technical solution of the dual-cylinder washing apparatus described above, the first blocking mechanism includes a first driving motor, a first blocking member, and a second blocking member; an output shaft of the first driving motor is connected with the first blocking member and the second blocking member simultaneously, the first blocking member is arranged in the first air inflow chamber, and the second blocking member is arranged in the first air outflow chamber; the first driving motor is capable of driving the first blocking member and the second blocking member to move simultaneously, so that the first air inflow chamber and the first air outflow chamber are blocked.

In a preferred technical solution of the dual-cylinder washing apparatus described above, the first driving motor is connected with a first transmission shaft, the first blocking member is a first blocking plate, and the second blocking member is a second blocking plate; the first blocking plate and the second blocking plate are both arranged on the first transmission shaft, and the first driving motor can drive the first transmission shaft to rotate so that the first blocking plate and the second blocking plate rotate simultaneously.

In a preferred technical solution of the dual-cylinder washing apparatus described above, the second blocking mechanism includes a second driving motor, a third blocking member, and a fourth blocking member; an output shaft of the second driving motor is connected with the third blocking member and the fourth blocking member simultaneously, the third blocking member is arranged in the second air inflow chamber, and the fourth blocking member is arranged in the second air outflow chamber; the second driving motor is capable of driving the third blocking member and the fourth blocking member to move simultaneously, so that the second air inflow chamber and the second air outflow chamber are blocked.

In a preferred technical solution of the dual-cylinder washing apparatus described above, the second driving motor is connected with a second transmission shaft, the third blocking member is a third blocking plate, and the fourth blocking member is a fourth blocking plate; the third blocking plate and the fourth blocking plate are both arranged on the second transmission shaft, and the second driving motor can drive the second transmission shaft to rotate so that the third blocking plate and the fourth blocking plate rotate simultaneously.

In a preferred technical solution of the dual-cylinder washing apparatus described above, a first opening communicated with the outside is arranged on a front panel of a cabinet of the dual-cylinder washing apparatus, and the first air outflow pipeline is communicated with the first opening.

In a preferred technical solution of the dual-cylinder washing apparatus described above, a first wind detection device is arranged at the first opening.

In a preferred technical solution of the dual-cylinder washing apparatus described above, a second opening communicated with the outside is arranged on a front panel of a cabinet of the dual-cylinder washing apparatus, and the second air outflow pipeline is communicated with the second opening.

In a preferred technical solution of the dual-cylinder washing apparatus described above, a second wind detection device is arranged at the second opening.

In a preferred technical solution of the dual-cylinder washing apparatus described above, the first cylinder assembly includes a first outer cylinder and a first window gasket that are connected, the first air inflow pipeline is communicated with the first window gasket, and the first air outflow pipeline is communicated with the first outer cylinder; and the second cylinder assembly includes a second outer cylinder and a second window gasket that are connected, the second air inflow pipeline is communicated with the second window gasket, and the second air outflow pipeline is communicated with the second outer cylinder.

In case of adopting the above technical solutions, the present disclosure can achieve partitioned washing of the dual-cylinder washing apparatus and independent air drying of each cylinder assembly. Taking the first cylinder assembly as an example, after the washing program of the first cylinder assembly is completed, the external air can enter the first air inflow pipeline by turning on the first fan, then enters the first cylinder assembly to achieve air drying of the interior of the first cylinder assembly, and finally is discharged from the first air outflow pipeline to avoid growth of bacteria inside the first cylinder assembly due to residual water. In addition, the first blocking mechanism can simultaneously block and separate the first air inflow pipeline and the first air outflow pipeline; the structure is simple, which facilitates the structural layout of the first cylinder assembly. Moreover, taking the second cylinder assembly as an example, after the washing program of the second cylinder assembly is completed, the external air can enter the second air inflow pipeline by turning on the second fan, then enters the second cylinder assembly to achieve air drying of the interior of the second cylinder assembly, and finally is discharged from the second air outflow pipeline to avoid growth of bacteria inside the second cylinder assembly due to residual water. In addition, the second blocking mechanism can simultaneously block and separate the second air inflow pipeline and the second air outflow pipeline; the structure is simple, which facilitates the structural layout of the second cylinder assembly. Through such an arrangement, the complexity of product design is reduced.

Further, the first driving motor can drive the first blocking member to block the first air inflow chamber, and at the same time drive the second blocking member to block the first air outflow chamber, thereby achieving simultaneous blocking of the first air inflow pipeline and the first air outflow pipeline. That is, the first driving motor is used as a driving source to achieve simultaneous blocking of the first air inflow pipeline and the first air outflow pipeline. The overall structure is simple, which facilitates the overall structural layout of the product, and reduces the complexity of product design.

Further, the first driving motor can drive the first transmission shaft to rotate, thereby achieving the rotation of the first blocking plate and the second blocking plate, and further achieving simultaneous blocking of the first air inflow chamber and the first air outflow chamber. Through such an arrangement, not only the first air inflow pipeline and the first air outflow pipeline can be blocked simultaneously, but also the space that the first valve assembly needs to occupy can be reduced as much as possible by means of rotational driving, which is more advantageous for the layout design of the overall spatial structure of the dual-cylinder washing apparatus; moreover, the structure is simple and easy to manufacture.

Further, the second driving motor can drive the third blocking member to block the second air inflow chamber, and at the same time drive the fourth blocking member to block the second air outflow chamber, thereby achieving simultaneous blocking of the second air inflow pipeline and the second air outflow pipeline. That is, the second driving motor is used as a driving source to achieve simultaneous blocking of the second air inflow pipeline and the second air outflow pipeline. The overall structure is simple, which facilitates the overall structural layout of the product, and reduces the complexity of product design.

Further, the second driving motor can drive the second transmission shaft to rotate, thereby achieving the rotation of the third blocking plate and the fourth blocking plate, and further achieving simultaneous blocking of the second air inflow chamber and the second air outflow chamber. Through such an arrangement, not only the second air inflow pipeline and the second air outflow pipeline can be blocked simultaneously, but also the space that the second valve assembly needs to occupy can be reduced as much as possible by means of rotational driving, which is more advantageous for the layout design of the overall spatial structure of the dual-cylinder washing apparatus; moreover, the structure is simple and easy to manufacture.

Further, the first wind detection device can detect whether the first air outflow pipeline has wind coming out, so that it can be judged whether the wind outflow of the first cylinder assembly of the dual-cylinder washing apparatus is normal, thereby facilitating users to know the wind outflow status, which is advantageous for the control of the first cylinder assembly, and further improves the user experience.

Further, the second wind detection device can detect whether the second air outflow pipeline has wind coming out, so that it can be judged whether the wind outflow of the second cylinder assembly of the dual-cylinder washing apparatus is normal, thereby facilitating users to know the wind outflow status, which is advantageous for the control of the second cylinder assembly, and further improves the user experience.

Further, the first air inflow pipeline is communicated with the first window gasket, and the first air outflow pipeline is communicated with the first outer cylinder, allowing external air to enter from the first window gasket so that the first window gasket is air dried first, and then the first outer cylinder is air dried; and finally, humid air is discharged through the first air outflow pipeline, allowing the first outer cylinder and the first window gasket to be air dried simultaneously; the second air inflow pipeline is communicated with the second window gasket, and the second air outflow pipeline is communicated with the second outer cylinder, allowing external air to enter from the second window gasket so that the second window gasket is air dried first, and then the second outer cylinder is air dried; and finally, humid air is discharged through the second air outflow pipeline, allowing the second outer cylinder and the second window gasket to be air dried simultaneously, thus avoiding secondary pollution and avoiding affecting the user experience during secondary washing of the clothing by the user.

BRIEF DESCRIPTION OF DRAWINGS

Preferred embodiments of the present disclosure will be described below with reference to the accompanying drawings and in connection with a dual-cylinder drum washing machine. In the drawings.

DETAILED DESCRIPTION

First, it should be understood by those skilled in the art that these embodiments are only used to explain the technical principle of the present disclosure, and are not intended to limit the scope of protection of the present disclosure. For example, although the present disclosure is described in connection with a dual-cylinder drum washing machine, the technical principle of the present disclosure is obviously also applicable to other dual-cylinder washing apparatuses, such as a dual-pulsator washing machine and a pulsator-drum combined washing machine. In addition, in the present disclosure, the first cylinder assembly and the second cylinder assembly can be a pure washing cylinder assembly or a washing-drying integrated cylinder assembly. Such adjustments or changes to the application object and the specific type of the cylinder assembly do not constitute limitations to the present disclosure, and should all be defined within the scope of protection of the present disclosure.

It should be noted that in the description of the present disclosure, terms indicating directional or positional relationships, such as "middle", "upper", "lower", "left", "right", "inner", "outer" and the like, are based on the directional or positional relationships shown in the accompanying drawings. They are only used for ease of description, and do not indicate or imply that the device or element must have a specific orientation, or be constructed or operated in a specific orientation; therefore, they should not be considered as limitations to the present disclosure. In addition, terms "first", "second", "third", "fourth", "fifth" and "sixth" are only used for descriptive purpose, and should not be understood as indicating or implying relative importance.

In addition, it should also be noted that in the description of the present disclosure, unless otherwise clearly specified and defined, terms "arrange", "install", "connect" and "communicate" should be understood in a broad sense; for example, the connection may be a fixed connection, or may also be a detachable connection, or an integral connection; it may be a direct connection, or an indirect connection implemented through an intermediate medium, or it may be internal communication between two elements. For those skilled in the art, the specific meaning of the above terms in the present disclosure can be interpreted according to specific situations.

In view of the problem pointed out in the "BACKGROUND" that existing dual-cylinder drum washing machines cannot achieve independent air drying at the same time of achieving partitioned washing, the present disclosure provides a dual-cylinder drum washing machine, aiming to achieve partitioned washing of the dual-cylinder drum washing machine and independent air drying of each cylinder assembly, and at the same time reduce the complexity of product design.

Figure 1:
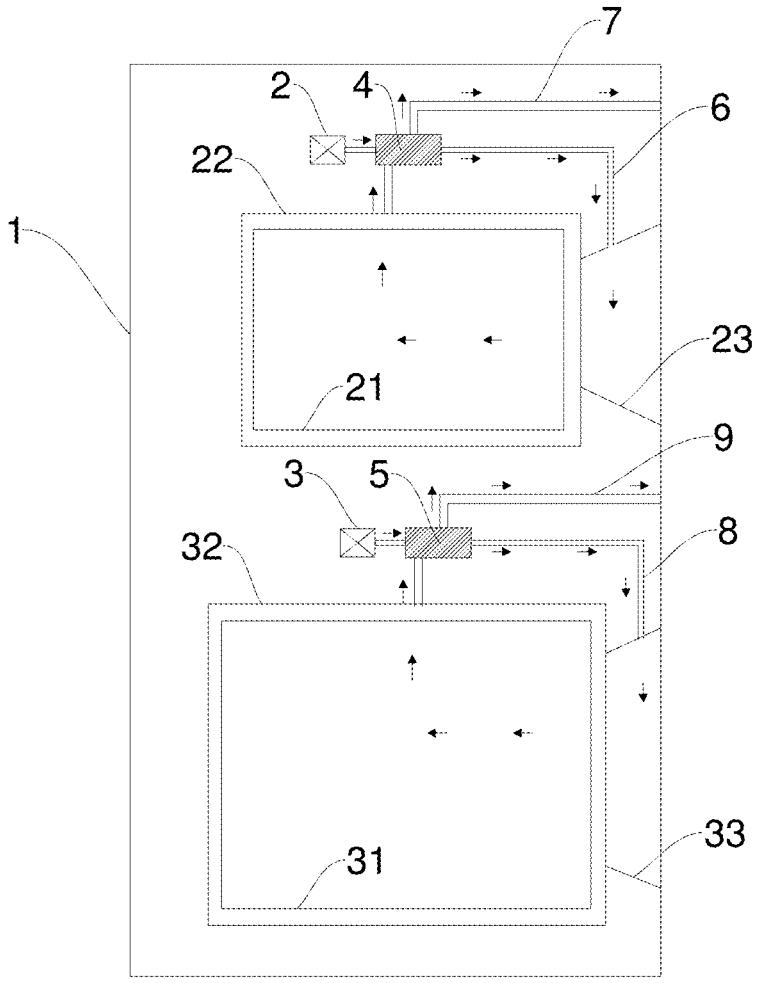
FIG. 1 is a schematic structural view of the dual-cylinder drum washing machine of the present disclosure.
Figure 2:
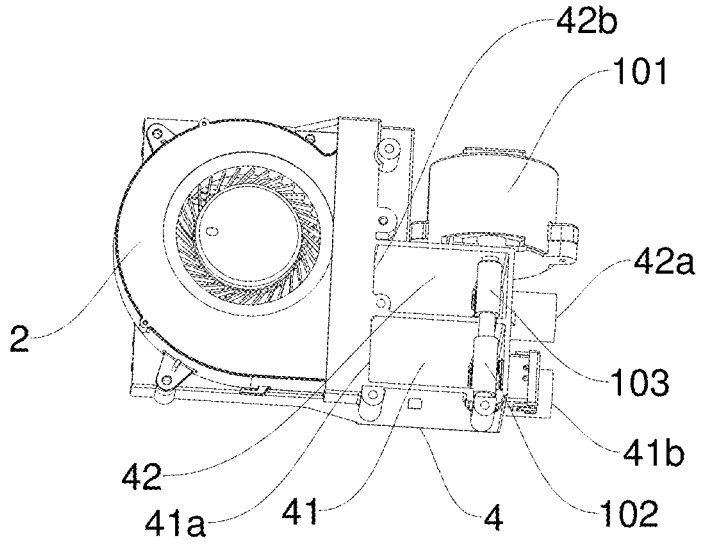
FIG. 2 is a first schematic structural view of a first valve assembly and a first fan of the dual-cylinder drum washing machine of the present disclosure.
Figure 3:
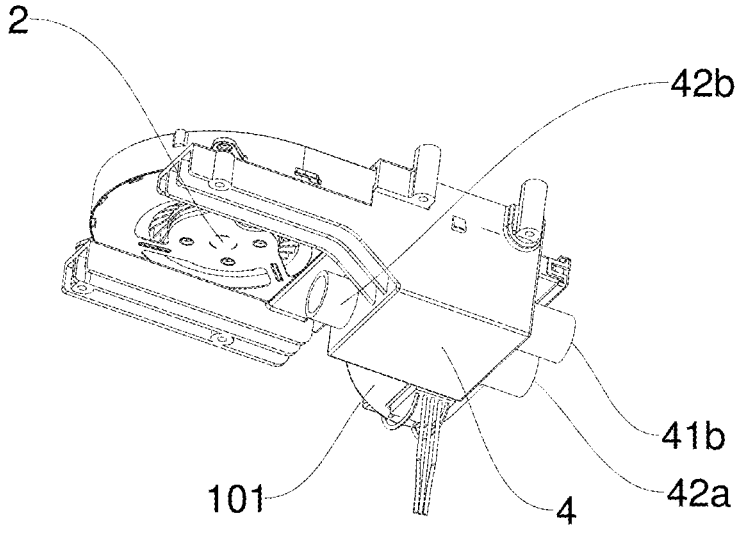
FIG. 3 is a second schematic structural view of the first valve assembly and the first fan of the dual-cylinder drum washing machine of the present disclosure.
Figure 4:
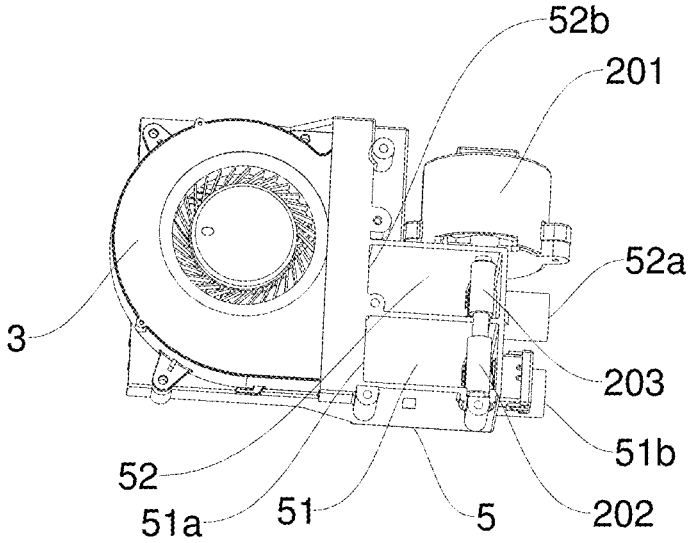
FIG. 4 is a first schematic structural view of a second valve assembly and a second fan of the dual-cylinder drum washing machine of the present disclosure.
Figure 5:
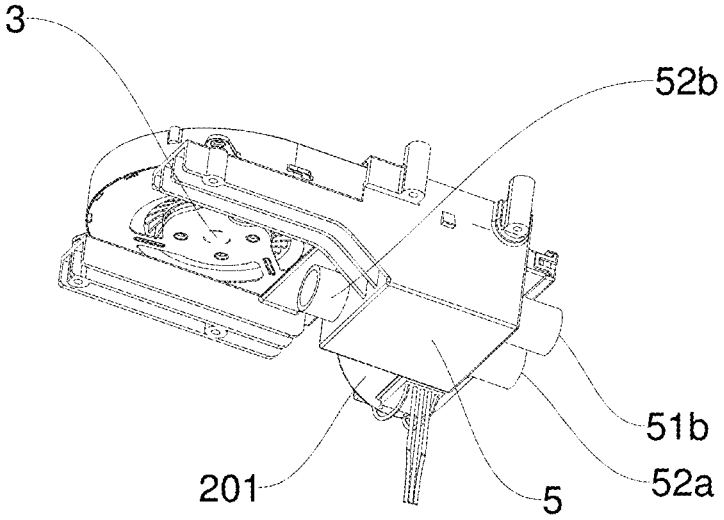
FIG. 5 is a second schematic structural view of the second valve assembly and the second fan of the dual-cylinder drum washing machine of the present disclosure.

Specifically, as shown in FIGS. 1 to 5, the dual-cylinder drum washing machine of the present disclosure includes a cabinet 1, a first cylinder assembly, a second cylinder assembly, a first valve assembly, a second valve assembly, a first fan 2 and a second fan 3. The first valve assembly includes a first blocking mechanism, and a first valve casing 4 with a first inflow chamber 41 and a first outflow chamber 42 that are arranged independently from each other; the first inflow chamber 41 is communicated with a first air inflow pipeline 6 that communicates the outside with the first cylinder assembly, and the first outflow chamber 42 is communicated with a first air outflow pipeline 7 that communicates the outside with the first cylinder assembly; the first fan 2 is arranged on the first air inflow pipeline 6 and/or the first air outflow pipeline 7, and the first blocking mechanism is arranged to be capable of blocking the first air inflow pipeline 6 and the first air outflow pipeline 7 from the outside simultaneously. The second valve assembly includes a second blocking mechanism, and a second valve casing 5 with a second inflow chamber 51 and a second outflow chamber 52 that are arranged independently from each other; the second inflow chamber 51 is communicated with a second air inflow pipeline 8 that communicates the outside with the second cylinder assembly, and the second outflow chamber 52 is communicated with a second air outflow pipeline 9 that communicates the outside with the second cylinder assembly; the second fan 3 is arranged on the second air inflow pipeline 8 and/or the second air outflow pipeline 9, and the second blocking mechanism is arranged to be capable of blocking the second air inflow pipeline 8 and the second air outflow pipeline 9 from the outside simultaneously. The first cylinder assembly includes a first inner cylinder 21, a first outer cylinder 22, and a first window gasket 23. The first inner cylinder 21 is rotatably arranged in the first outer cylinder 22, and the first window gasket 23 connects an opening of the first outer cylinder 22 with a first clothing throw-in port of the cabinet 1. The first inner cylinder 21 can be directly driven to rotate by a direct driving motor, and can also be driven to rotate by a belt, which is driven by a motor. The first outer cylinder 22 is configured to hold washing water, the first inner cylinder 21 is configured to turn over the clothing, and the first window gasket 23 ensures the sealing between the first outer cylinder 22 and the first clothing throw-in port of the cabinet 1. The second cylinder assembly includes a second inner cylinder 31, a second outer cylinder 32, and a second window gasket 33. The second inner cylinder 31 is rotatably arranged in the second outer cylinder 32, and the second window gasket 33 connects an opening of the second outer cylinder 32 with a second clothing throw-in port of the cabinet 1. The second inner cylinder 31 can be directly driven to rotate by a direct driving motor, and can also be driven to rotate by a belt, which is driven by a motor. The second outer cylinder 32 is configured to hold washing water, the second inner cylinder 31 is configured to turn over the clothing, and the second window gasket 33 ensures the sealing between the second outer cylinder 32 and the second clothing throw-in port of the cabinet 1. As shown in FIGS. 2 and 3, when the first air inflow chamber 41 is communicated with the first air inflow pipeline 6 that communicates the outside with the first cylinder assembly, it is possible that the outside is directly communicated with the air inlet 41*a* of the first air inflow chamber 41, and then the air outlet 41*b* of the first air inflow chamber 41 is communicated with the first cylinder assembly through the first air inflow pipeline 6, or it is also possible that the first air inflow pipeline 6 has two sections, one of which communicates the outside with the air inlet 41*a* of the first air inflow chamber 41, and the other of which communicates the air outlet 41*b* of the first air inflow chamber 41 with the first cylinder assembly. Similarly, when the first air outflow chamber 42 is communicated with the first air outflow pipeline 7 that communicates the outside with the first cylinder assembly, it is possible that the air outlet 42*b* of the first air outflow chamber 42 is directly communicated with the outside, and then the first cylinder assembly is communicated with the air inlet 42*a* of the first air outflow chamber 42 through the first air outflow pipeline 7, or it is also possible that the first air outflow pipeline 7 has two sections, one of which communicates the first cylinder assembly with the air inlet 42*a* of the first air outflow chamber 42, and the other of which communicates the air outlet 42*b* of the first air outflow chamber 42 with the outside. Likewise, as shown in FIGS. 4 and 5, when the second air inflow chamber 51 is communicated with the second air inflow pipeline 8 that communicates the outside with the second cylinder assembly, it is possible that the outside is directly communicated with the air inlet 51*a* of the second air inflow chamber 51, and then the air outlet 51*b* of the second air inflow chamber 51 is communicated with the second cylinder assembly through the second air inflow pipeline 8, or it is also possible that the second air inflow pipeline 8 has two sections, one of which communicates the outside with the air inlet 51*a* of the second air inflow chamber 51, and the other of which communicates the air outlet 51*b* of the second air inflow chamber 51 with the second cylinder assembly. Similarly, when the second air outflow chamber 52 is communicated with the second air outflow pipeline 9 that communicates the outside with the second cylinder assembly, it is possible that the air outlet 52*b* of the second air outflow chamber 52 is directly communicated with the outside, and then the second cylinder assembly is communicated with the air inlet 52*a* of the second air outflow chamber 52 through the second air outflow pipeline 9, or it is also possible that the second air outflow pipeline 9 has two sections, one of which communicates the second cylinder assembly with the air inlet 52*a* of the second air outflow chamber 52, and the other of which communicates the air outlet 52*b* of the second air outflow chamber 52 with the outside. Preferably, as shown in FIG. 1, the first air inflow pipeline 6 is communicated with the first window gasket 23, and the first air outflow pipeline 7 is communicated with the first outer cylinder 22; the second air inflow pipeline 8 is communicated with the second window gasket 33, and the second air outflow pipeline 9 is communicated with the second outer cylinder 32. In practical applications, those skilled in the art can flexibly set the connection position of the first air inflow pipeline 6 with the first window gasket 23, the connection position of the first air outflow pipeline 7 with the first outer cylinder 22, the connection position of the second air inflow pipeline 8 with the second window gasket 33, and the connection position of the second air outflow pipeline 9 with the second outer cylinder 32. Preferably, the first air inflow pipeline 6 is communicated with the top of the first window gasket 23, the first air outflow pipeline 7 is communicated with the top of the first outer cylinder 22, the second air inflow pipeline 8 is communicated with the top of the second window gasket 33, and the second air outflow pipeline 9 is communicated with the top of the second outer cylinder 32, so as to prevent water from entering the pipelines during washing of the drum washing machine.

Preferably, as shown in FIGS. 2 and 3, the first blocking mechanism includes a first driving motor 101, a first blocking member 102, and a second blocking member 103; an output shaft of the first driving motor 101 is connected with the first blocking member 102 and the second blocking member 103 simultaneously, the first blocking member 102 is arranged in the first air inflow chamber 41, and the second blocking member 103 is arranged in the first air outflow chamber 42; the first driving motor 101 is capable of driving the first blocking member 102 and the second blocking member 103 to move simultaneously, so that the first air inflow chamber 41 and the first air outflow chamber 42 are blocked. The first driving motor 101 can be a rotating motor that eventually outputs a rotational force, or a linear motor that eventually outputs a linear driving force. For example, in a preferred situation, the first driving motor 101 is connected with a first transmission shaft, the first blocking member 102 is a first blocking plate, and the second blocking member 103 is a second blocking plate. The first blocking plate and the second blocking plate are both arranged on the first transmission shaft, and the first driving motor 101 can drive the first transmission shaft to rotate so that the first blocking plate and the second blocking plate rotate simultaneously. That is, the first driving motor 101 is a rotating motor, and the first driving motor 101 can drive the first transmission shaft to rotate. The first transmission shaft drives the first blocking plate and the second blocking plate to rotate simultaneously. The air inlet 41*a* and the air outlet 41*b* of the first air inflow chamber 41 can be located on opposite sides of the first air inflow chamber 41 respectively, or on adjacent sides of the first air inflow chamber 41 respectively. Similarly, the air inlet 42*a* and the air outlet 42*b* of the first air outflow chamber 42 can be located on opposite sides of the first air outflow chamber 42 respectively, or on adjacent sides of the first air outflow chamber 42 respectively. According to the respective arrangement positions of the air inlet and the air outlet of the first air inflow chamber 41 as well as the air inlet and the air outlet of the first air outflow chamber 42, the ways of blocking the first blocking plate and the second blocking plate can be flexibly set respectively. In a preferred situation, as shown in FIGS. 2 and 3, the air outlet 41*b* of the first air inflow chamber 41 and the air inlet 42*a* of the first air outflow chamber 42 are located on the same side of the first valve casing 4, that is, the air outlet 41*b* of the first air inflow chamber 41 is located on the same side as the air inlet 42*a* of the first air outflow chamber 42. The first driving motor 101 drives the first transmission shaft to rotate so that the first blocking plate can cover the air outlet 41*b* of the first air inflow chamber 41, thereby achieving the blocking of the first air inflow pipeline 6, and at the same time, the second blocking plate can cover the air inlet 42*a* of the first air outflow chamber 42, thereby achieving the blocking of the first air outflow pipeline 7. Moreover, since it is the air outlet 41*b* of the first air inflow chamber 41 and the air inlet 42*a* of the first air outflow chamber 42 that are covered respectively, even if foam is generated in the washing process of the first cylinder assembly, it will not enter the first air inflow chamber 41 and the first air outflow chamber 42. Moreover, it is further preferred that one side of the first blocking plate that faces the air outlet 41*b* of the first air inflow chamber 41 and one side of the second blocking plate that faces the air inlet 42*a* of the first air outflow chamber 42 are each provided with a sealing gasket, so that sealing can be achieved when the first blocking plate covers the air outlet 41*b* of the first air inflow chamber 41, and sealing can also be achieved when the second blocking plate covers the air inlet 42*a* of the first air outflow chamber 42. In other examples, the scaling gasket on the first blocking plate can be replaced with a sealing ring that can correspond to the shape of the air outlet 41*b* of the first air inflow chamber 41, and the scaling gasket on the second blocking plate can be replaced with a sealing ring that can correspond to the shape of the air inlet 42*a* of the first air outflow chamber 42.

Preferably, as shown in FIG. 2, the first transmission shaft extends from the outside through one side of the first valve casing 4, the first air outflow chamber 42 and the first air inflow chamber 41 in sequence, and the first transmission shaft is rotatably arranged on a first spacer plate that separates the first air inflow chamber 41 from the first air outflow chamber 42. In a possible situation, a first through hole is formed on one side of the first valve casing 4 that forms the first air outflow chamber 42, a second through hole is formed on the first spacer plate, and the first transmission shaft passes through the first through hole and the second through hole in sequence. The part of the first transmission shaft that is located between the first through hole and the second through hole (i.e., the part inside the first air outflow chamber 42) is connected with the second blocking plate, and the part of the first transmission shaft that protrudes out of the second through hole (i.e., the part inside the first air inflow chamber 41) is connected with the first blocking plate. In addition, the first transmission shaft can be connected with an edge of the first blocking plate and also connected with an edge of the second blocking plate, so that the rotation of the transmission shaft can achieve synchronous swinging of the first blocking plate and the second blocking plate. Moreover, a third through hole can also be provided on a side of the first valve casing 4 opposite to the side on which the first through hole is provided, and the protruding end of the first transmission shaft can be located in the third through hole. Through such an arrangement, the first transmission shaft can be supported by the first through hole, the second through hole and the third through hole altogether, thus improving the stability of the support. The first driving motor 101 is located outside the first valve casing 4, and it can be connected with the cabinet 1 of the dual-cylinder drum washing machine through an installation bracket, or it can be directly welded to the cabinet 1 of the dual-cylinder drum washing machine. In other examples, it is also possible that the first transmission shaft extends from the outside through one side of the first valve casing 4, the first air inflow chamber 41 and the first air outflow chamber 42 in sequence.

Alternatively, the first driving motor 101 is a linear motor, the first blocking member 102 is a first blocking plate, and the second blocking member 103 is a second blocking plate. A first slot communicated with the first air inflow chamber 41 and a second slot communicated with the first air outflow chamber 42 are respectively formed on the same side of the first valve casing 4. The first blocking plate is inserted into and matched with the first slot, and the second blocking plate is inserted into and matched with the second slot. The linear motor can drive the first blocking plate and the second blocking plate to move linearly and synchronously. When it is necessary to block the first air inflow chamber 41 and the first air outflow chamber 42, the linear motor drives the first blocking plate to be inserted into the first air inflow chamber 41 from the first slot so that the first blocking plate blocks the air inlet 41*a* of the first air inflow chamber 41 from the air outlet 41*b* of the first air inflow chamber 41, and at the same time, the linear motor drives the second blocking plate to be inserted into the first air outflow chamber 42 from the second slot so that the second blocking plate blocks the air inlet 42*a* of the first air outflow chamber 42 from the air outlet 42*b* of the first air outflow chamber 42. In the above, the linear motor can also be replaced with a structure such as a hydraulic cylinder or a pneumatic cylinder.

Preferably, as shown in FIGS. 4 and 5, the second blocking mechanism includes a second driving motor 201, a third blocking member 202, and a fourth blocking member 203; an output shaft of the second driving motor 201 is connected with the third blocking member 202 and the fourth blocking member 203 simultaneously, the third blocking member 202 is arranged in the second air inflow chamber 51, and the fourth blocking member 203 is arranged in the second air outflow chamber 52; the second driving motor 201 is capable of driving the third blocking member 202 and the fourth blocking member 203 to move simultaneously, so that the second air inflow chamber 51 and the second air outflow chamber 52 are blocked. The second driving motor 201 can be a rotating motor that eventually outputs a rotational force, or a linear motor that eventually outputs a linear driving force. For example, in a preferred situation, the second driving motor 201 is connected with a second transmission shaft, the third blocking member 202 is a third blocking plate, and the fourth blocking member 203 is a fourth blocking plate. The third blocking plate and the fourth blocking plate are both arranged on the second transmission shaft, and the second driving motor 201 can drive the second transmission shaft to rotate so that the third blocking plate and the fourth blocking plate rotate simultaneously. That is, the second driving motor 201 is a rotating motor, and the second driving motor 201 can drive the second transmission shaft to rotate. The second transmission shaft drives the third blocking plate and the fourth blocking plate to rotate simultaneously. The air inlet 51*a* and the air outlet 51*b* of the second air inflow chamber 51 can be located on opposite sides of the second air inflow chamber 51 respectively, or on adjacent sides of the second air inflow chamber 51 respectively. Similarly, the air inlet 52*a* and the air outlet 52*b* of the second air outflow chamber 52 can be located on opposite sides of the second air outflow chamber 52 respectively, or on adjacent sides of the second air outflow chamber 52 respectively. According to the respective arrangement positions of the air inlet and the air outlet of the second air inflow chamber 51 as well as the air inlet and the air outlet of the second air outflow chamber 52, the ways of blocking the third blocking plate and the fourth blocking plate can be flexibly set respectively. In a preferred situation, as shown in FIGS. 4 and 5, the air outlet 51*b* of the second air inflow chamber 51 and the air inlet 52*a* of the second air outflow chamber 52 are located on the same side of the second valve casing 5, that is, the air outlet 51*b* of the second air inflow chamber 51 is located on the same side as the air inlet 52*a* of the second air outflow chamber 52. The second driving motor 201 drives the second transmission shaft to rotate so that the third blocking plate can cover the air outlet 51*b* of the second air inflow chamber 51, thereby achieving the blocking of the second air inflow pipeline 8, and at the same time, the fourth blocking plate can cover the air inlet 52*a* of the second air outflow chamber 52, thereby achieving the blocking of the second air outflow pipeline 9. Moreover, since it is the air outlet 51*b* of the second air inflow chamber 51 and the air inlet 52*a* of the second air outflow chamber 52 that are covered respectively, even if foam is generated in the washing process of the second cylinder assembly, it will not enter the second air inflow chamber 51 and the second air outflow chamber 52. Moreover, it is further preferred that one side of the third blocking plate that faces the air outlet 51*b* of the second air inflow chamber 51 and one side of the fourth blocking plate that faces the air inlet 52*a* of the second air outflow chamber 52 are each provided with a sealing gasket, so that scaling can be achieved when the third blocking plate covers the air outlet 51*b* of the second air inflow chamber 51, and sealing can also be achieved when the fourth blocking plate covers the air inlet 52*a* of the second air outflow chamber 52. In other examples, the sealing gasket on the third blocking plate can be replaced with a scaling ring that can correspond to the shape of the air outlet 51*b* of the second air inflow chamber 51, and the sealing gasket on the fourth blocking plate can be replaced with a scaling ring that can correspond to the shape of the air inlet 52*a* of the second air outflow chamber 52.

Preferably, as shown in FIG. 4, the second transmission shaft extends from the outside through one side of the second valve casing 5, the second air outflow chamber 52 and the second air inflow chamber 51 in sequence, and the second transmission shaft is rotatably arranged on a second spacer plate that separates the second air inflow chamber 51 from the second air outflow chamber 52. In a possible situation, a fourth through hole is formed on one side of the second valve casing 5 that forms the second air outflow chamber 52, a fifth through hole is formed on the second spacer plate, and the second transmission shaft passes through the fourth through hole and the fifth through hole in sequence. The part of the second transmission shaft that is located between the fourth through hole and the fifth through hole (i.e., the part inside the second air outflow chamber 52) is connected with the fourth blocking plate, and the part of the second transmission shaft that protrudes out of the fifth through hole (i.e., the part inside the second air inflow chamber 51) is connected with the third blocking plate. In addition, the second transmission shaft can be connected with an edge of the third blocking plate and also connected with an edge of the fourth blocking plate, so that the rotation of the transmission shaft can achieve synchronous swinging of the third blocking plate and the fourth blocking plate. Moreover, a sixth through hole can also be provided on a side of the second valve casing 5 opposite to the side on which the fourth through hole is provided, and the protruding end of the second transmission shaft can be located in the sixth through hole. Through such an arrangement, the second transmission shaft can be supported by the fourth through hole, the fifth through hole and the sixth through hole altogether, thus improving the stability of the support. The second driving motor 201 is located outside the second valve casing 5, and it can be connected with the cabinet 1 of the dual-cylinder drum washing machine through an installation bracket, or it can be directly welded to the cabinet 1 of the dual-cylinder drum washing machine. In other examples, it is also possible that the second transmission shaft extends from the outside through one side of the second valve casing 5, the second air inflow chamber 51 and the second air outflow chamber 52 in sequence.

Alternatively, the second driving motor 201 is a linear motor, the third blocking member 202 is a third blocking plate, and the fourth blocking member 203 is a fourth blocking plate. A third slot communicated with the second air inflow chamber 51 and a fourth slot communicated with the second air outflow chamber 52 are respectively formed on the same side of the second valve casing 5. The third blocking plate is inserted into and matched with the third slot, and the fourth blocking plate is inserted into and matched with the fourth slot. The linear motor can drive the third blocking plate and the fourth blocking plate to move linearly and synchronously. When it is necessary to block the second air inflow chamber 51 and the second air outflow chamber 52, the linear motor drives the third blocking plate to be inserted into second air inflow chamber 51 from the third slot so that the third blocking plate blocks the air inlet 51*a* of the second air inflow chamber 51 from the air outlet 51*b* of the second air inflow chamber 51, and at the same time, the linear motor drives the fourth blocking plate to be inserted into the second air outflow chamber 52 from the fourth slot so that the fourth blocking plate blocks the air inlet 52*a* of the second air outflow chamber 52 from the air outlet 52*b* of the second air outflow chamber 52. In the above, the linear motor can also be replaced with a structure such as a hydraulic cylinder or a pneumatic cylinder.

Preferably, a first opening communicated with the outside is arranged on a front panel of the cabinet 1 of the dual-cylinder drum washing machine of the present disclosure, and the first air outflow pipeline 7 is communicated with the first opening; a second opening communicated with the outside is arranged on the front panel of the cabinet 1, and the second air outflow pipeline 9 is communicated with the second opening. In the present disclosure, the first cylinder assembly and the second cylinder assembly can be arranged left and right, or arranged up and down. For example, the first cylinder assembly is located above the second cylinder assembly. In this case, the first opening is preferably located above the second opening, that is, the position at which the first opening is arranged corresponds to the first cylinder assembly, and the position at which the second opening is arranged corresponds to the second cylinder assembly, so as to facilitate the arrangement of the first air inflow pipeline 6, the first air outflow pipeline 7, the second air inflow pipeline 8 and the second air outflow pipeline 9.

Further, a first wind detection device is provided at the first opening, and the first wind detection device can be a flow sensor or another device capable of detecting wind outflow. Through the first wind detection device, it can be judged whether the first cylinder assembly of the dual-cylinder drum washing machine is executing the ventilation program normally. A second wind detection device is provided at the second opening, and the second wind detection device can be a flow sensor or another device capable of detecting wind outflow. Through the second wind detection device, it can be judged whether the second cylinder assembly of the dual-cylinder drum washing machine is executing the ventilation program normally. More preferably, humidity sensors are arranged at both the first opening and the second opening. For example, a first humidity sensor is arranged at the first opening, and a second humidity sensor is arranged at the second opening. The first humidity sensor and the second humidity sensor can detect the wind humidity of the first air outflow pipeline 7 and the wind humidity of the second air outflow pipeline 9 respectively. Then, an ambient humidity sensor in communication with a controller of the dual-cylinder drum washing machine (such as through WiFi, Bluetooth communication, etc.) is arranged in the space in which the dual-cylinder drum washing machine is located. By comparing the ambient humidity detected by the ambient humidity sensor with the humidity detected by the first humidity sensor or the second humidity sensor, if the difference between the humidity detected by the ambient humidity sensor and the humidity detected by the first humidity sensor is smaller than a first preset humidity value (which can be a relative humidity value of 5%), it indicates that the wind humidity of the first cylinder assembly is roughly consistent with or close to the ambient humidity, and the first cylinder assembly of the drum washing machine can stop executing the ventilation program; and if the difference between the humidity detected by the ambient humidity sensor and the humidity detected by the second humidity sensor is smaller than a second preset humidity value (which can be a relative humidity value of 5%), it indicates that the wind humidity of the second cylinder assembly is roughly consistent with or close to the ambient humidity, and the second cylinder assembly of the drum washing machine can stop executing the ventilation program. After both the first cylinder assembly and the second cylinder assembly have stopped the ventilation program, the humidity detected by the first humidity sensor can be further compared with the humidity detected by the second humidity sensor. If the difference between the humidity detected by the first humidity sensor and the humidity detected by the second humidity sensor is larger than a third preset humidity value (which can be a relative humidity value of 3%), it is highly likely that the ambient humidity sensor has failed. At this time, the first cylinder assembly and the second cylinder assembly may not have truly achieved a desired air drying effect, the ambient humidity sensor should be repaired, and the first humidity sensor and the second humidity sensor can also be inspected at the same time.

Preferably, a portion of the first air inflow pipeline 6 is adjacent to and arranged side by side with a portion of the first air outflow pipeline 7. The portion of the first air inflow pipeline 6 that is adjacent to the first air outflow pipeline 7 is formed with a first air chamber, and the portion of the first air outflow pipeline 7 that is adjacent to the first air inflow pipeline 6 is formed with a second air chamber. The first fan 2 includes a first fan motor, a first electrical fan, and a second electrical fan. The first electrical fan is arranged in the first air chamber, and the second electrical fan is arranged in the second air chamber. The first fan motor is connected to the first electrical fan through a first gear pair structure, and the first fan motor is connected to the second electrical fan through a second gear pair structure. When the first fan motor is running, it can drive the first electrical fan and the second electrical fan to rotate simultaneously. A wind direction through the first air inflow pipeline 6 is from the outside to the first window gasket 23, and a wind direction through the first air outflow pipeline 7 is from the first outer cylinder 22 to the outside. Therefore, a single driving source can simultaneously drive two electrical fans to achieve air inflow and air outflow of the first cylinder assembly, thus improving the air drying efficiency at the same time of simplifying the structure. Similarly, a portion of the second air inflow pipeline 8 is adjacent to and arranged side by side with a portion of the second air outflow pipeline 9. The portion of the second air inflow pipeline 8 that is adjacent to the second air outflow pipeline 9 is formed with a third air chamber, and the portion of the second air outflow pipeline 9 that is adjacent to the second air inflow pipeline 8 is formed with a fourth air chamber. The first fan 2 includes a second fan motor, a third electrical fan, and a fourth electrical fan. The third electrical fan is arranged in the third air chamber, and the fourth electrical fan is arranged in the fourth air chamber. The second fan motor is connected to the third electrical fan through a third gear pair structure, and the second fan motor is connected to the fourth electrical fan through a fourth gear pair structure. When the second fan motor is running, it can drive the third electrical fan and the fourth electrical fan to rotate simultaneously. A wind direction through the second air inflow pipeline 8 is from the outside to the second window gasket 33, and a wind direction through the second air outflow pipeline 9 is from the second outer cylinder 32 to the outside. Therefore, a single driving source can simultaneously drive two electrical fans to achieve air inflow and air outflow of the second cylinder assembly, thus improving the air drying efficiency at the same time of simplifying the structure.

In the present disclosure, the capacity of the first cylinder assembly and the capacity of the second cylinder assembly can be the same or different. For example, the first cylinder assembly is located above the second cylinder assembly, and the capacity of the first cylinder assembly is smaller than the capacity of the second cylinder assembly. Running programs for the first cylinder assembly and running programs for the second cylinder assembly can be simultaneously set on a control panel of the dual-cylinder drum washing machine. The number of the running programs can be the same, or it is also possible that the number of the running programs for the first cylinder assembly is smaller than the number of the running programs for the second cylinder assembly. For example, the first cylinder assembly has fourteen selectable running programs, and the second cylinder assembly has twenty selectable running programs. In addition, the first cylinder assembly and the second cylinder assembly carry out partitioned washing, in which the first cylinder assembly can wash clothing of infants, and the second cylinder assembly can wash clothing of non-infants.

Hitherto, the technical solutions of the present disclosure have been described in connection with the preferred embodiments shown in the accompanying drawings, but it is easily understood by those skilled in the art that the scope of protection of the present disclosure is obviously not limited to these specific embodiments. Without departing from the principles of the present disclosure, those skilled in the art can make equivalent changes or replacements to relevant technical features, and all the technical solutions after these changes or replacements will fall within the scope of protection of the present disclosure.

What is claimed is:

1. A dual-cylinder washing apparatus, comprising:

a first cylinder assembly, a second cylinder assembly, a first valve assembly, a second valve assembly, a first fan and a second fan;

wherein the first valve assembly comprises a first blocking mechanism, and a first valve casing with a first inflow chamber and a first outflow chamber that are arranged independently from each other; the first inflow chamber is communicated with a first air inflow pipeline that communicates an outside of the washing apparatus with the first cylinder assembly, and the first outflow chamber is communicated with a first air outflow pipeline that communicates the outside with the first cylinder assembly; the first fan is arranged on the first air inflow pipeline and/or the first air outflow pipeline, and the first blocking mechanism is arranged to be capable of blocking the first air inflow pipeline and the first air outflow pipeline from the outside simultaneously; and the second valve assembly comprises a second blocking mechanism, and a second valve casing with a second inflow chamber and a second outflow chamber that are arranged independently from each other; the second inflow chamber is communicated with a second air inflow pipeline that communicates the outside with the second cylinder assembly, and the second outflow chamber is communicated with a second air outflow pipeline that communicates the outside with the second cylinder assembly; the second fan is arranged on the second air inflow pipeline and/or the second air outflow pipeline, and the second blocking mechanism is arranged to be capable of blocking the second air inflow pipeline and the second air outflow pipeline from the outside simultaneously.

2. The dual-cylinder washing apparatus according to claim 1, wherein the first blocking mechanism comprises a first driving motor, a first blocking member, and a second blocking member; an output shaft of the first driving motor is connected with the first blocking member and the second blocking member simultaneously, the first blocking member is arranged in the first air inflow chamber, and the second blocking member is arranged in the first air outflow chamber; the first driving motor is capable of driving the first blocking member and the second blocking member to move simultaneously, so that the first air inflow chamber and the first air outflow chamber are blocked.

3. The dual-cylinder washing apparatus according to claim 2, wherein the first driving motor is connected with a first transmission shaft, the first blocking member is a first blocking plate, and the second blocking member is a second blocking plate; the first blocking plate and the second blocking plate are both arranged on the first transmission shaft, and the first driving motor can drive the first transmission shaft to rotate so that the first blocking plate and the second blocking plate rotate simultaneously.

4. The dual-cylinder washing apparatus according to claim 3, wherein the second blocking mechanism comprises a second driving motor, a third blocking member, and a fourth blocking member; an output shaft of the second driving motor is connected with the third blocking member and the fourth blocking member simultaneously, the third blocking member is arranged in the second air inflow chamber, and the fourth blocking member is arranged in the second air outflow chamber; the second driving motor is capable of driving the third blocking member and the fourth blocking member to move simultaneously, so that the second air inflow chamber and the second air outflow chamber are blocked.

5. The dual-cylinder washing apparatus according to claim 4, wherein the second driving motor is connected with a second transmission shaft, the third blocking member is a third blocking plate, and the fourth blocking member is a fourth blocking plate; the third blocking plate and the fourth blocking plate are both arranged on the second transmission shaft, and the second driving motor can drive the second transmission shaft to rotate so that the third blocking plate and the fourth blocking plate rotate simultaneously.

6. The dual-cylinder washing apparatus according to claim 1, wherein a first opening communicated with the outside is arranged on a front panel of a cabinet of the dual-cylinder washing apparatus, and the first air outflow pipeline is communicated with the first opening.

7. The dual-cylinder washing apparatus according to claim 6, wherein a second opening communicated with the outside is arranged on a front panel of a cabinet of the dual-cylinder washing apparatus, and the second air outflow pipeline is communicated with the second opening.

8. The dual-cylinder washing apparatus according to claim 1, wherein the first cylinder assembly comprises a first outer cylinder and a first window gasket that are connected, the first air inflow pipeline is communicated with the first window gasket, and the first air outflow pipeline is communicated with the first outer cylinder; and the second cylinder assembly comprises a second outer cylinder and a second window gasket that are connected, the second air inflow pipeline is communicated with the second window gasket, and the second air outflow pipeline is communicated with the second outer cylinder.

* * * * *